United States Patent [19]

Dietz

[11] Patent Number: 4,570,687

[45] Date of Patent: Feb. 18, 1986

[54] METHOD AND APPARATUS FOR PRODUCING LUMBER PRODUCTS WHICH ARE MACHINED ON ALL SIDES

[75] Inventor: Hans Dietz, Ammerbuch-Pfaffingen, Fed. Rep. of Germany

[73] Assignee: Wurster u. Dietz GmbH u. Co. Maschinenfabrik, Tübingen-Derendingen, Fed. Rep. of Germany

[21] Appl. No.: 557,351

[22] Filed: Dec. 1, 1983

[30] Foreign Application Priority Data

Dec. 1, 1982 [DE] Fed. Rep. of Germany ..... 3244393

[51] Int. Cl.[4] ..... B27C 1/08

[52] U.S. Cl. ..... 144/378; 144/39; 144/41; 144/369; 144/377; 83/435.2; 83/708

[58] Field of Search ..... 144/39, 41, 356, 357, 144/369, 370, 376, 377, 378; 83/35, 36, 56, 367, 364, 708, 709, 710, 711, 712, 435.2

[56] References Cited

U.S. PATENT DOCUMENTS 4,262,572 4/1981 Flodin ..... 83/704

4,316,491 2/1982 Kearnes et al. ..... 144/39

*Primary Examiner*—W. D. Bray

*Assistant Examiner*—Jorji M. Griffin

*Attorney, Agent, or Firm*—Becker & Becker

[57] ABSTRACT

A method and apparatus for producing lumber products which are machined on all sides. With this method, the curved trunk which is to be machined, and which increases approximately conically in thickness toward one of its ends, is first, prior to flattening its longitudinal sides and cutting off boards, aligned relative to a processing line of sawmill equipment in such a way that its longitudinal central plane, which is disposed in the direction of curvature of the trunk, extends approximately parallel to the machining surfaces of side cutting devices which flatten the longitudinal sides of the trunk. After that, a portion of the large trunk end which projects beyond an alignment plane is flattened. This flattening is effected in a plane which is tangential to the two trunk ends on a convexly curved surface portion thereof.

8 Claims, 7 Drawing Figures

METHOD AND APPARATUS FOR PRODUCING LUMBER PRODUCTS WHICH ARE MACHINED ON ALL SIDES

BACKGROUND OF THE INVENTION

1. Field of the Invention

The present invention relates to a method of producing lumber products, such as square timbers and/or boards or the like, which are machined on all sides. According to this method, in a first machining phase, a trunk, which is larger toward one end and is curved in the longitudinal direction, first has one longitudinal central plane thereof which is disposed in its direction of curvature aligned in a position approximately parallel to the machining planes of two side cutting devices; the machining planes of the side cutting devices are parallel to one another, and the side cutting devices are disposed across from one another on both sides of a processing line of a machining station of a sawmill equipment. In a subsequent machining step, the trunk is flattened on two opposite longitudinal sides with the side cutting devices. Thereafter, boards which are provided with the flattened sides are cut off. The present invention also relates to an apparatus for carrying out this method. This apparatus has a conveying device for the trunk, and two side cutting devices which are disposed across from one another on both sides of the conveying device.

2. Description of the Prior Art

German Pat. No. 29 28 949 discloses a method according to which the trunk is first flattened on all sides. After that, edges, including bark, are milled or cut out, and subsequently a board exposed in this way is cut off of each side of the trunk. The remaining square portion of the trunk can be used subsequently, for example, as square timber, or can be cut up into boards.

This known method does not take into account that the trunk which is to be machined has generally grown somewhat crooked, and that one of its ends is generally considerably larger than the other end. As a rule, the increase in diameter of a trunk, measured in the direction of the larger end thereof, is 0.5 to 1.5 centimeters per meter. Depending upon the natural curve of the trunk and the respective need for cut lumber, the round timber which is to be machined or cut has a length of from 1 to 10 meters. Trunks which had grown particularly irregularly were, up to now, split up into sections having as small a curvature as possible. However, even these trunk sections still have a curvature, a so-called residual curvature.

Pursuant to another known method (German Offenlegungsschrift No. 31 14 843), only the above described taper of the trunk is taken into account. After the longitudinal sides are flattened, edges are milled or cut out by vertical movement of the trimming cutters in such a way that they form an angle relative to the horizontal.

With both of these heretofore known methods the curvature of the trunk is not taken into account during alignment and flattening. As a result, the cross-sectional area of the trunk which is actually available is not fully utilized, so that the yield from the trunk is not optimal.

Pursuant to German Auslegeschrift No. 26 05 987, in the method of the general type described at the beginning of the specification the curvature of the trunk is taken into account to the extent that after alignment the trunk is laterally flattened, is turned by 90 degrees, and is then split by a central cut along its curved center line into two equally sized blocks. These blocks are then fed for further machining to separate conveyors, block reducing stations and cutting stations. That side located across from the central cut surface is first sawed off, and a plurality of boards are subsequently cut off. The block obtained at the cutting station is curved in conformity with the curvature of the trunk, and must therefore be subsequently linearly straightened by conditioning and drying.

Not only are these post treatments expensive and time consuming, but also only can be realized to a limited extent. For example, fresh and greatly curved lumber cannot be straightened in this manner. Furthermore, the saw blades of the saws of the cutting station are very greatly stressed when carrying out the curved cuts, so that already after a relatively short time these saw blades heat up considerably and can even break. The saw chain must then be replaced, which involves considerable cost and loss of production. Finally, the apparatus required for this known method is structurally very complicated and expensive, since for transporting and machining each block half the apparatus must be equipped with a duplicate set of tools. Therefore, the apparatus also requires a relatively large amount of space.

An object of the present invention is to provide a method and apparatus of the initially mentioned general type embodied in such a way that even greatly curved trunks, in a simple manner and with as large a yield as possible, can be split up into main products and boards exclusively with straight cuts.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
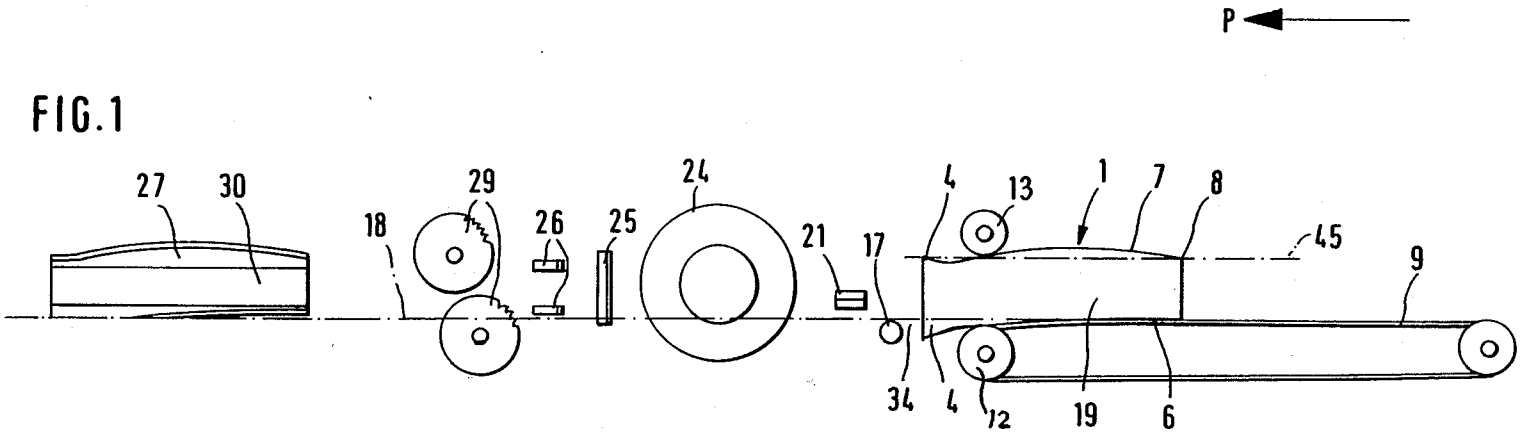
FIG. 1, in a schematically illustrated side view, shows a trunk which, in a first machining phase pursuant to the inventive method, is passing through a first machining station which is provided with a plurality of tools which are successively arranged in the direction of transport of the trunk.

The method of the present invention is characterized primarily in that the trunk, at that surface portion thereof which is concavely curved when viewed in the longitudinal direction of the trunk, is flattened at least partially at the larger end thereof in a plane which is disposed at right angles to the machining surfaces of the side cutting devices and is disposed approximately parallel to a plane which is tangential to the two ends of the trunk on the other surface portion thereof which is convexly curved when viewed in the longitudinal direction of the trunk.

The apparatus of the present invention is characterized primarily in that a further machining tool, preferably a trimming cutter, for flattening the large trunk end, is disposed between the conveying device and the side cutting devices; the machining surfaces of this further machining tool is disposed at right angles to the machining surfaces of the side cutting devices.

Pursuant to the inventive method, subsequent to alignment the trunk is first at least partially flattened at the larger end thereof on the concavely curved surface portion thereof. If, after the subsequent flattening of the longitudinal sides and the following cutting off of the boards, the trunk is turned, for example, by 90° in order to be able to machine the other longitudinal sides of the trunk, the concavely curved surface portion thereof which is subsequently to be flattened is then already partially machined by the flattened portion of the large trunk end, so that the curvature is no longer of such great significance during this alignment process.

Since the large trunk end is at least partially flattened, the trunk can thus be placed in a position in which the average cross-sectional area of the trunk can be completely utilized, as a result of which an optimum trunk yield is achieved. In so doing, the trunk can be exclusively machined by straight cuts, so that only straight pieces are obtained. As a result, time consuming and costly subsequent processing for straightening curved pieces can be eliminated. Furthermore, the saw blades used for machining the trunk are stressed only minimally by the straight cuts in comparison to curved cuts, so that they are exposed to considerably less wear.

The inventive apparatus is simple in construction since only one additional machining tool, namely a trimming cutter, is required in order to remove that portion of the large trunk end which projects beyond the alignment plane of the trunk. This trimming cutter flattens the overhanging portion of the large trunk end prior to the flattening of the longitudinal sides of the trunk. The remaining tools, and their arrangement in the sawmill equipment, correspond to the known apparatus, whereby to machine the trunk only one appropriate tool is required. Thus, an optimum yield of curved trunks can be achieved with the inventive apparatus with relatively little additional mechanical expense. Furthermore, the inventive apparatus can be converted from a known apparatus in a simple manner since only the single additional tool has to be installed.

Pursuant to specific embodiments of the method of the present invention, the convexly curved surface portion of the trunk may be directed upwardly, and the trunk ends of the concavely curved surface portions may rest on the transport device. After alignment, the trunk may be lowered in such a way that the ends on the convexly curved surface portion may be disposed approximately in a horizontal plane. The large end of the trunk may be lowered to below a transport plane. After flattening the large end of the trunk, the longitudinal sides thereof may be flattened approximately parallel to the longitudinal central plane thereof. During flattening of the large trunk end, there is also possible to cut off greatly curved root sections or the like which have dropped during transport into a free space which is disposed prior to the tool which machines the large trunk end, which is preferably directed toward the front when viewed in the direction of transport.

Pursuant to specific embodiments of the apparatus of the present invention, the free space may be provided between the machine tool for the large end of the trunk and the conveying device. The free space, measured in the direction of transport of the trunk, may have a length of from approximately 0.3 m to 1.5 m. The side cutting devices and the machining tool for the large end of the trunk may be spaced from one another. The conveying device, which is disposed prior to the machining tool for the large end of the trunk, may be capable of being lowered. The machining tool can be embodied in such a way that it can be moved out of contact with the trunk.

DESCRIPTION OF PREFERRED EMBODIMENTS

Referring now to the drawings in detail, the inventive method, which is subsequently explained with the aid of FIGS. 1–5, serves for machining trunk sections which are to be cut up in a sawmill into lumber products, such as square timber and/or boards, which are machined on all sides. The diameters of such trunks naturally increase somewhat conically from one end of the trunk to the other; furthermore, the trunks have almost always grown bent or curved.

The trunks or long trunk sections which are to be cut up are first split up into shorter trunk sections in such a way that they are curved now only in one dimension, namely in the longitudinal direction of the trunk.

Figure 2:
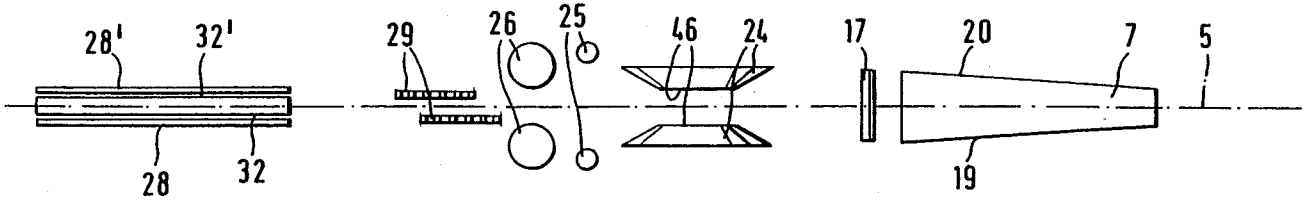
FIG. 2 is a plan view of the machining station of FIG. 1.
Figure 5:
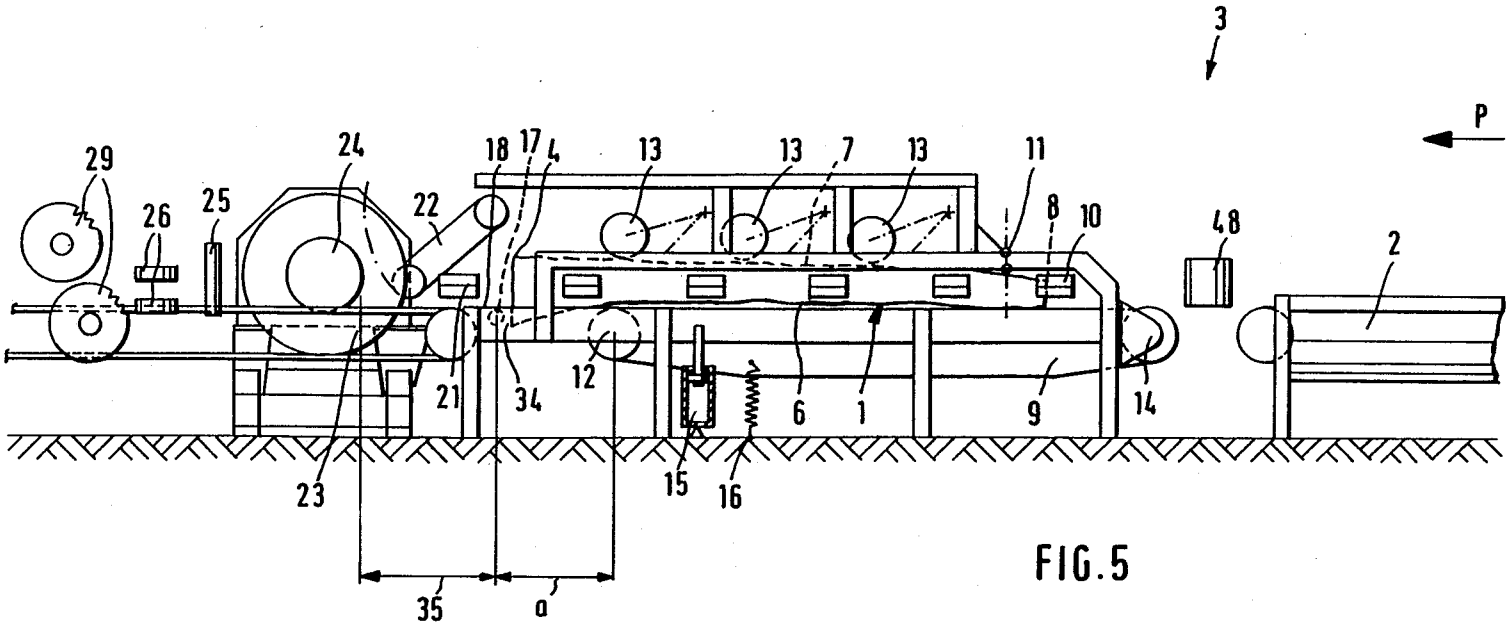
FIG. 5 is a schematic illustration of one inventive embodiment of equipment for carrying out the inventive method.

As shown in particular in FIG. 5, the trunk 1 which is to be machined is first placed upon a longitudinal conveyor 2 of the sawmill equipment 3 in such a way that its larger end 4 is pointed toward the front in the direction of transport or feed P. The trunk 1 is thereupon aligned on the conveyor 2 in such a way that its longitudinal central plane, which extends in the direction of curvature, is disposed symmetrically to a processing line of the sawmill equipment. In this connection, the trunk 1 is preferably disposed in such a way that the longitudinal central plane lies in the vertical central plane of the processing line (FIG. 2). To the right and to the left of the processing line are disposed the machining surfaces 46 of side cutting devices 24 which face one another; the machining surfaces 46 are disposed substantially parallel to one another. Subsequent to the alignment and partial flattening of the larger trunk end 4, the longitudinal sides of the trunk 1 are flattened with the side cutting devices 24.

It is also possible to incline the longitudinal central plane of the trunk at any desired angle relative to the vertical plane 5 provided the axes of those machining tools of the sawmill equipment 3 which, when viewed in the transport direction P, successively come into use form a corresponding angle with the vertical central plane 5.

Subsequent to the aforementioned alignment of the trunk 1 on a horizontal plane of the longitudinal conveyor 2, the trunk is transported in the direction P and is turned by a subsequent turning device 48, so that the concavely curved surface portion 6 is directed downwardly toward the longitudinal conveyor 2, and the convexly curved surface portion 7 is directed upwardly. After this, only the trunk ends 4 and 8 of the trunk 1 are disposed on a second longitudinal conveyor 9 which, when viewed in the direction P, is disposed in front of the first longitudinal conveyor 2. As the trunk 1 is further transported, the trunk 1 is held firmly in place by pairs of guiding heads 10, which laterally engage the trunk 1 symmetrical to the central plane 5 and hold the trunk 1 in the upwardly aligned position and symmetrical to the central plane. After the trunk 1 has been turned, the trunk 1 passes through a measuring device 11 in which the entire length is measured and the diameter of the small trunk end 8 is determined.

As soon as the large trunk end 4 has reached the vicinity of a forward drive pulley 12, as viewed in the direction P, rollers 13, which press against the truck 1 from above, and the longitudinal conveyor 9, which is rotatable about a mounting 14, are controlled in such a way that the longitudinal conveyor 9 is lowered. So that the longitudinal conveyor 9 can be lowered uniformly and constantly, support members, such as a spring 16 and a piston-cylinder arrangement 15, are disposed below the chain bed. These support parts exert a counter force on the longitudinal conveyor 9 which is being lowered, or control the movement.

In order to achieve an optimum yield of main and auxiliary products, the longitudinal conveyor 9 is lowered until the large trunk end 4 of the convex surface portion 7 is at the same level, i.e. in a common horizontal plane 45, with the rear small trunk end 8 (see in particular the schematic illustration of the apparatus and its machining stations as shown in FIGS. 1–4).

After the trunk 1 has been thus aligned and lowered into an ideal starting position, the trunk 1 is fed to a trimming cutter 17 which is approximately tangential to the transport plane 18. The large trunk end 4, which projects downwardly beyond the transport plane 18, is flattened with this trimmer 17 in the vicinity of the concave surface portion 6 in such a way that the large trunk end 4 is greatly flattened, and the small trunk end 8 is only slightly flattened or is not flattened at all.

After that, the trunk 1 enters a horizontally effective pair of guiding heads 21, and is additionally held down and conveyed further in the direction P by a conveying device 22. In the region of these two conveying means 21, 22, the trunk 1 is placed upon a transport device 23 which conveys the trunk to the side cutting devices 24. Those longitudinal sides 19, 20 of the trunk 1 which are essentially parallel to the central plane 5 are flattened by these side cutting devices 24.

As the trunk 1 is transported further, conveying rollers 25 rest against these flattened longitudinal sides 19, 20; the rollers 25 bring the trunk 1 into a subsequent milling device 26. The milling device 26 trims edges 27 from side boards 28, 28' which are to be cut off in a later operation. These boards are cut off by the subsequently arranged circular saws 29.

In the event, in order to determine the optimum trimming width, there is necessary to have an exact measurement of the cut surfaces 30, 31, accompanied by subsequent alignment of the saws 29, the cutting devices 24 and the milling and saw devices 26, 29 are sufficiently spaced from one another. However, there is generally sufficient to embody the measuring device 11 in such a way that the milling device 26 can be correctly positioned based upon the determined minimum diameter of the trunk, and as a function of the desired cutting pattern.

The trunk 1 also can be placed upon the longitudinal conveyor 2 in such a way that the small trunk end 8 points to the front when viewed in the direction P. In so doing, lowering of the longitudinal conveyor 9 must take place parallel to the transport plane 18.

The lowering process is effected after the small trunk end 8 is placed on the transport device 23.

After the trunk 1 has passed through this first cutting or machining phase, the trunk 1 is preferably turned by 90° and is either returned to the same machining station or is further transported into a second, subsequent (non-illustrated) machining station which essentially corresponds to the first machining station shown in FIGS. 1 and 5. In this case, a roll-over device can be arranged between the first and second milling stations for turning the trunk 1.

In this second machining phase, the trunk 1 only needs to be aligned symmetrically to the central plane 5, since now the planar interfaces 32, 32' which remain after the side boards 28, 28' are cut off, and no longer the concavely curved surface portion 6, rest upon the conveying device. Therefore, in the second machining phase the trunk 1 is first laterally symmectrically centered on the associated conveying device.

Figure 3:
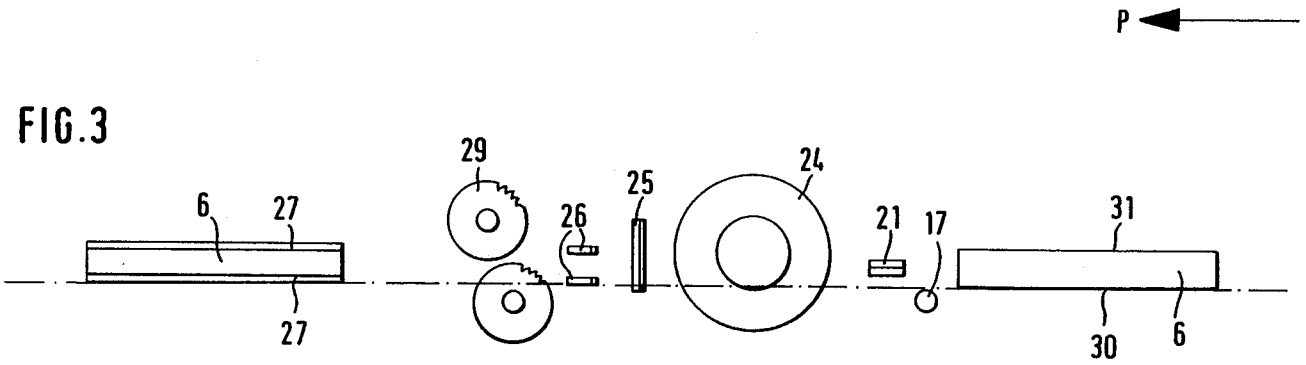
FIG. 3 is a schematically illustrated side view of a trunk which has been flattened in the first machining phase and after having been turned again passes through the first machining station in a second machining phase.
Figure 4:
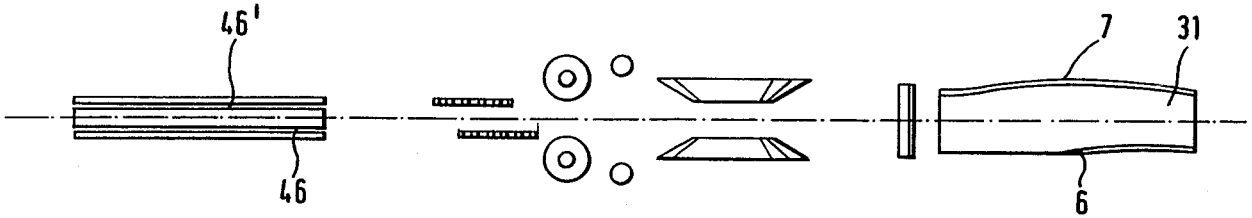
FIG. 4 is a plan view of the machining station of FIG. 3.

When the trunk is machined in the second phase as shown in FIGS. 3 and 4 after being returned to the apparatus of FIG. 5, the longitudinal conveyor 9 no longer has to be lowered. Instead, it is held at approximately the same level as the transport plane 18, so that during transport of the trunk 1 the trimming cutter 17 no longer comes into engagement with the trunk.

As the trunk 1 passes for the second time through the same machining station or through a second subsequently arranged machining station, and after horizontal alignment of the trunk, the still unmachined parts of the surface portions 6, 7 are flattened and the edges and associated side boards 46, 46' (FIG. 4) are cut off, so that there remains a square timber 33 (FIG. 6) which has an essentially square cross section and can be used as building lumber. However, the square timber also can be fed to a trimming device in which, in further machining stages, the timber is cut up into beams or boards. This trimming device can be formed by the circular saws 29 if the latter are adjustable.

As shown in particular in FIG. 5, the axis of the trimming cutter 17 is spaced from the axis of the forward mounting roller 12 of the longitudinal conveyor 9 by the distance "a", which is preferably from 0.3 to 1.5 m. The free space 34 is thus formed into which the large trunk end 4 drops when the longitudinal conveyor 9 is lowered. However, greatly curved (non-illustrated) root sections of the trunk 1 also drop into this free space when the trunk is fed to the trimming cutter 17 in the transport direction P without in so doing affecting the alignment results. These root sections then can be cut off by the trimmer 17, so that additional devices for removing these root sections, which devices would be connected ahead of the machining station 3, can be eliminated. If the small trunk end 8 is directed toward the front, the free space 34 has no function for the root sections.

Figures 6A, 6B:
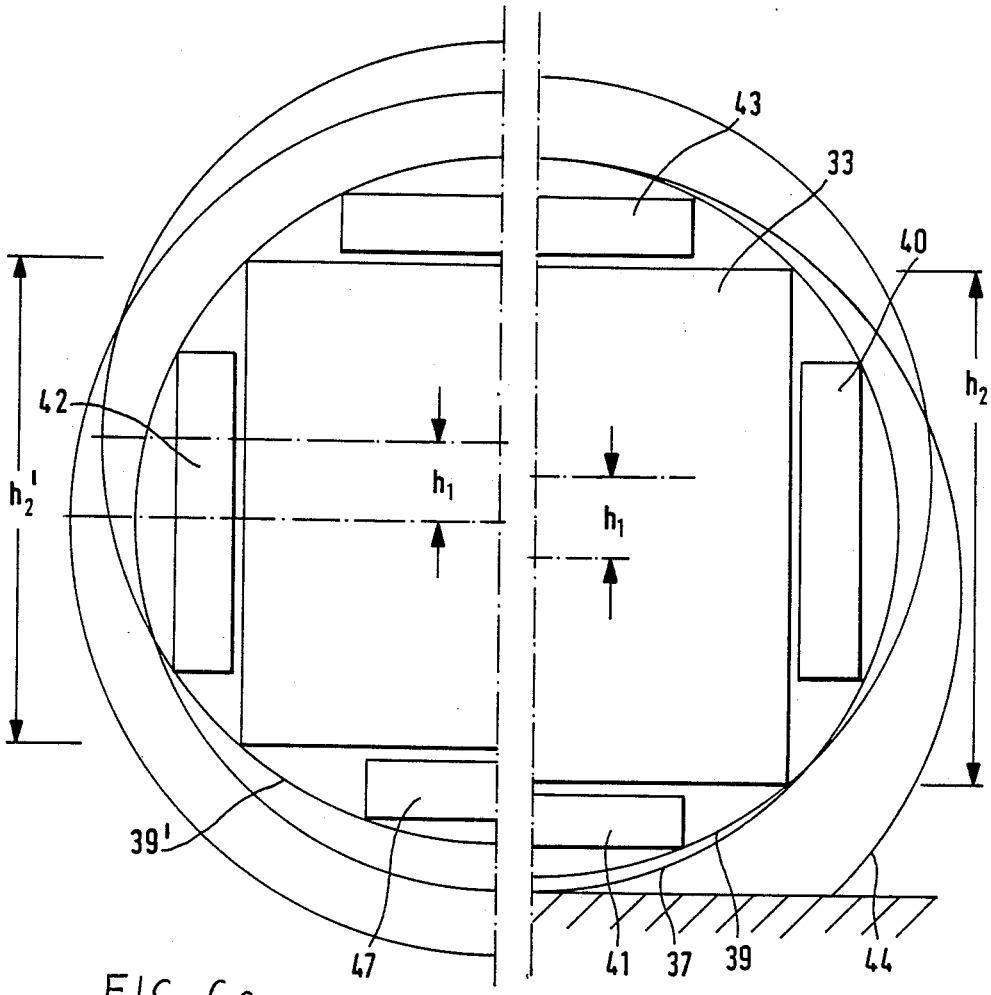
FIG. 6*a* diagrammatically illustrates the full utilization of the cross-sectional area of the trunk pursuant to a heretofore known method.
FIG. 6*b* diagrammatically illustrates the full utilization of the cross-sectional area of the trunk pursuant to the method of the present invention.

FIG. 6*a* shows the yield of a trunk machined pursuant to a heretofore known method, and FIG. 6*b* shows the yield of a trunk machined pursuant to the aforementioned inventive method. Pursuant to the inventive method as described with the aid of FIGS. 1 to 5, the large trunk end is greatly cut or trimmed, and the small trunk end is hardly cut at all if at all. As a result, as can be clearly seen in FIG. 6*b*, the average trunk diameter 39 pursuant to the method of FIGS. 1 to 5 is considerably closer to the smallest trunk diameter 37 as is the case with the heretofore known method (compare FIG. 6*a*). By using the known method, the average trunk diameter 39', in contrast, is spaced much further from the smallest trunk diameter 37. Thus, an optimum yield can be achieved with the inventive method. When a trunk having a smallest diameter 37 of 230 mm, a largest diameter 44 of 370 mm, an average diameter 39 of 250 mm, and a curvature height $h_1$ is machined pursuant to the method of the present invention, four boards 40 to 43 having the same height and width, namely the dimensions 18×100 mm, and also a square timber 33 having a lateral length $h_2$ of 162 mm, can be produced. In contrast, only three of the four boards produced pursuant to the heretofore known method have the same dimensions as the boards 40 to 43. The other board 47 produced by the heretofore known method only has a width of 80 mm. Furthermore, the lateral lengths $h_2'$ of the square timber produced pursuant to the heretofore known method are shorter by 10 mm, only having a length of 152 mm.

This comparison clearly shows that even with a greatly curved trunk, the largest possible yield of main and auxiliary products can be assured with the inventive method illustrated in FIGS. 1 to 5.

The present invention is, of course, in no way restricted to the specific disclosure of the specification and drawings, but also encompasses any modifications within the scope of the appended claims.

I claim:

1. A method of producing lumber products from a tree trunk in a processing line of a machining station of a sawmill installation with which the lumber products are machined on all sides, and the trunk has a small end as well as a thicker large end as the trunk increases in thickness from the small end to the thicker large end; the trunk is also curved in the longitudinal direction thereof, and has a central longitudinal plane disposed in the direction of curvature; the trunk has two opposed longitudinal sides, and between them a surface portion which is concavely curved in the longitudinal direction of the trunk, and a surface portion which is convexly curved in the longitudinal direction of the trunk; said method comprising the steps of:

first aligning said central longitudinal plane of said trunk to be approximately parallel to the machining surfaces of two side cutting devices which are arranged across from one another on both sides of said processing line of said machining station; said machining surfaces of said side cutting devices being parallel to one another;

thereafter aligning the trunk in the vertical direction for equalization of strong curvature by lowering only said thicker trunk end so that the trunk ends of the convexly curved surface portion lie in a plane which lies at right angles to said machining surfaces and which lies approximately parallel to a machining plane of a machining tool for flattening of the trunk located in the transporting direction thereof before the lowered trunk end;

flattening said concavely curved surface portion of said trunk, by at least partially flattening only at said lowered thicker large end thereof in order to equalize the curvature thereof extensively when the trunk is aligned in vertical direction, said flattening occurring in a plane which is at right angles to said machining surfaces of said side cutting devices and approximately parallel to a plane which is tangential to said large and small trunk ends on said convexly curved surface portion;

then flattening said trunk on said two opposed longitudinal sides thereof with said side cutting devices over entire length of the trunk whereby a lower horizontal surface results to serve as a guide during further processing thereof; and subsequently cutting off boards from said flattened longitudinal sides for realizing maximum production yield from the trunk.

2. A method according to claim 1, which includes the additional steps of turning said trunk by 90° after said cutting off step, and flattening said convexly and concavely curved surface portions, to the extent not already done, with said side cutting devices.

3. A method according to claim 1, in which said aligning step includes placing said large and small trunk ends at said concavely curved surface portion on a transporting device, so that said convexly curved surface portion is directed upwardly.

4. A method according to claim 1, which includes the step of lowering said trunk, after said aligning step, in such a way that said large and small trunk ends at said convexly curved surface portion are disposed approximately in a horizontal plane.

5. A method according to claim 4, which includes the steps of transporting said trunk in a transport plane, and lowering said large end of said trunk to below said transport plane.

6. A method according to claim 1, in which said step of flattening said opposed longitudinal sides of said trunk includes flattening said longitudinal sides approximately parallel to said central longitudinal plane of said trunk.

7. A method according to claim 1, in which said step of at least partially flattening said large trunk end on said concavely curved surface portion of said trunk also includes cutting off greatly curved root sections which during transport have dropped into a free space disposed, when viewed in the direction of travel of a trunk through said processing line, prior to a tool which effects said flattening of said concavely curved surface portion.

8. A method according to claim 1, which includes the step of aligning said trunk in such a way that, when viewed in the direction of travel of a trunk through said processing line, said large end of said trunk is ahead of said small end thereof.

* * * * *